US007541750B2

(12) United States Patent
Shen et al.

(10) Patent No.: US 7,541,750 B2
(45) Date of Patent: Jun. 2, 2009

(54) DC TO DC CONVERTER WITH LOAD OPEN DETECTION AND RELATED METHOD THEREOF

(75) Inventors: Yi-Lun Shen, Hsin-Chu (TW); Da-Chun Wei, Hsin-Chu (TW)

(73) Assignee: Leadtrend Technology Corp., Hsin-Chu (TW)

( * ) Notice: Subject to any disclaimer, the term of this patent is extended or adjusted under 35 U.S.C. 154(b) by 6 days.

(21) Appl. No.: 11/754,358

(22) Filed: May 28, 2007

(65) Prior Publication Data

US 2008/0298088 A1 Dec. 4, 2008

(51) Int. Cl.
*H05B 37/02* (2006.01)

(52) U.S. Cl. ..... 315/291; 315/307; 315/360

(58) Field of Classification Search ..... 315/209 R, 315/224, 246, 291, 307–308, 312, 360; 363/15–16, 363/20, 34, 123, 159
See application file for complete search history.

(56) References Cited

U.S. PATENT DOCUMENTS 5,465,029 A * 11/1995 Hanazaki et al. ..... 315/308
6,515,434 B1 * 2/2003 Biebl ..... 315/291
6,747,420 B2 * 6/2004 Barth et al. ..... 315/291
6,759,811 B2 * 7/2004 Okamoto et al. ..... 315/291
6,853,155 B2 * 2/2005 Yamamoto et al. ..... 315/291
7,276,861 B1 * 10/2007 Shteynberg et al. ..... 315/291
2007/0001624 A1 * 1/2007 Blondia ..... 315/291

* cited by examiner

*Primary Examiner*—David Hung Vu
*Assistant Examiner*—Tung X Le
(74) *Attorney, Agent, or Firm*—Winston Hsu

(57) ABSTRACT

Disclosed is a DC to DC converter, which comprises: a transforming circuit, for transforming an input voltage to an output voltage; a comparator, for comparing a reference voltage and a feedback voltage proportional to the output voltage to generate a comparing signal; a control circuit, coupled to the transforming circuit and the comparator, for controlling the transforming circuit according to the comparing signal; and a time-counting device, coupled to the control circuit, for counting the time of a specific voltage level of the comparing signal; wherein the time-counting device informs the control circuit that a load open situation occurs if the specific voltage level of the comparing signal lasts a predetermined time, then the control circuit turns off the transforming circuit.

15 Claims, 4 Drawing Sheets

DC TO DC CONVERTER WITH LOAD OPEN DETECTION AND RELATED METHOD THEREOF

BACKGROUND OF THE INVENTION

1. Field of the Invention

The present invention relates to a DC to DC converter and a related method thereof, and particularly relates to a DC to DC converter with load open detection and a related method thereof.

2. Description of the Prior Art

FIG. 1 is a circuit diagram illustrating a prior art LED driving circuit 100 for transforming an input voltage $V_{in}$ to an output voltage $V_{out}$ according to desired luminance to drive a plurality of LEDs 101. As shown in FIG. 1, the LED driving circuit 100 comprises a dimming control circuit 103, a hysteresis comparator 105, a comparator 106, a control circuit 107, an inverter 109, and a transforming circuit 120 comprising a NMOS 111, an inductance 113, a diode 115 and a capacitor 119. The dimming control circuit 103 is used for generating a first reference voltage $V_{ref1}$ according to a second reference voltage $V_{ref2}$ and a dimming control voltage DCV, which is used for adjusting the luminance of the LEDs 101. The hysteresis comparator 105 is used for comparing the first reference voltage $V_{ref1}$ and a feedback voltage $V_{FB}$ proportional to the output voltage $V_{out}$ to generate a comparing signal COS. As known by persons skilled in the art, the hysteresis comparator 105 is used for limiting the feedback voltage $V_{FB}$ between a region, instead of limiting the feedback voltage $V_{FB}$ to a specific value. Since the detail operation is well known, the detail description of the hysteresis comparator 105 is omitted for brevity. In this case, a loading current IL flows through the LEDs 101 and the resistor 117, therefore a voltage drop exists on the LEDs 101, and the feedback voltage $V_{FB}$ is generated accordingly.

The control circuit 107 is used for generating a control signal CS. The inverter 109 is used for inverting the control signal CS to control the NMOS 111. If the feedback voltage $V_{FB}$ is lower than the first reference voltage $V_{ref1}$, the control circuit 107 makes the transforming circuit 120 generate a higher output voltage $V_{out}$. Similarly, if the feedback voltage $V_{FB}$ is higher than the first reference voltage $V_{ref1}$, the control circuit 107 makes the transforming circuit 120 generate a lower output voltage $V_{out}$. Also, the hysteresis comparator 105, the comparator 106, the control circuit 107 and the transforming circuit 120 can be regarded as a DC to DC converter.

The comparator 106 is used for detecting a load open situation. If the circuit at the side of the LEDs 101 is open, the feedback voltage $V_{FB}$ is 0, so the comparator 106 will compare the feedback voltage $V_{FB}$ and a third reference voltage $V_{ref3}$. If the feedback voltage $V_{FB}$ is lower than the third reference voltage $V_{ref3}$, the comparator 106 will inform the control circuit 107 that a load open situation has occurred, and the control circuit 107 will turn off the NMOS 111. The third reference voltage $V_{ref3}$ is normally 0.1V. Such a mechanism has some disadvantages, however.

The control circuit 107 can be a switching circuit or a logic circuit such as an AND gate. In this case, when the LED driving circuit 100 operates normally, the control signal CS is equal to comparing signal COS. If the feedback voltage $V_{FB}$ is lower than the third reference voltage $V_{ref3}$, the comparator 106 will inform the control circuit 107 that a load open situation has occurred, the comparing signal COS can not pass through the control circuit 107, and the control signal CS will keep on logic high level, thus the NMOS 111 will be turned off In other words, the control circuit 107 will turn off the NMOS 111 by blocking the comparing signal COS.

FIG. 2 is a schematic diagram illustrating the relation of the first reference voltage $V_{ref1}$, the second reference voltage $V_{ref2}$, and the dimming control voltage DCV shown in FIG. 1. As shown in region A of FIG. 2, the first reference voltage $V_{ref1}$ is proportional to the dimming control voltage DCV if the dimming control voltage DCV is smaller than a threshold voltage $V_{th}$ (for example, 3.5V). In region B, the first reference voltage $V_{ref1}$ is limited to the second reference voltage $V_{ref2}$ if the dimming control voltage DCV is larger than a threshold voltage $V_{th}$. As described above, if the feedback voltage $V_{FB}$ is lower than the third reference voltage $V_{ref3}$, it is determined that the load open situation has occurred. However, if the first reference voltage $V_{ref1}$ determined by the dimming control voltage DCV in region A is smaller than the third reference voltage level $V_{ref3}$, a normal situation may be determined to be a load open situation. Thus, this system is subject to errors.

SUMMARY OF THE INVENTION

Therefore, one objective of the present invention is to provide a DC to DC converter to directly count the time for a load open situation to stop transforming an input voltage.

One embodiment of the present invention discloses a DC to DC converter, which comprises: a transforming circuit, for transforming an input voltage to an output voltage; a comparator, for comparing a reference voltage and a feedback voltage proportional to the output voltage to generate a comparing signal; a control circuit, coupled to the transforming circuit and the comparator, for controlling the transforming circuit according to the comparing signal; and a time-counting device, coupled to the control circuit, for counting the time of a specific voltage level of the comparing signal; wherein the time-counting device informs the control circuit that a load open situation occurs if the specific voltage level of the comparing signal lasts a predetermined time, then the control circuit turns off the transforming circuit.

Another embodiment of the present invention discloses a load open detection method for a DC to DC converter comprising a transforming circuit for transforming an input voltage to an output voltage. The method comprises: (a) detecting a switching operation of the transforming circuit; and (b) determining a load open situation happened if the transforming circuit is not switched for more than a predetermined time.

According to the above-mentioned embodiment, since a contradiction between the load open determination and normal operation does not exist, an erroneous determination of a load open situation will not occur.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
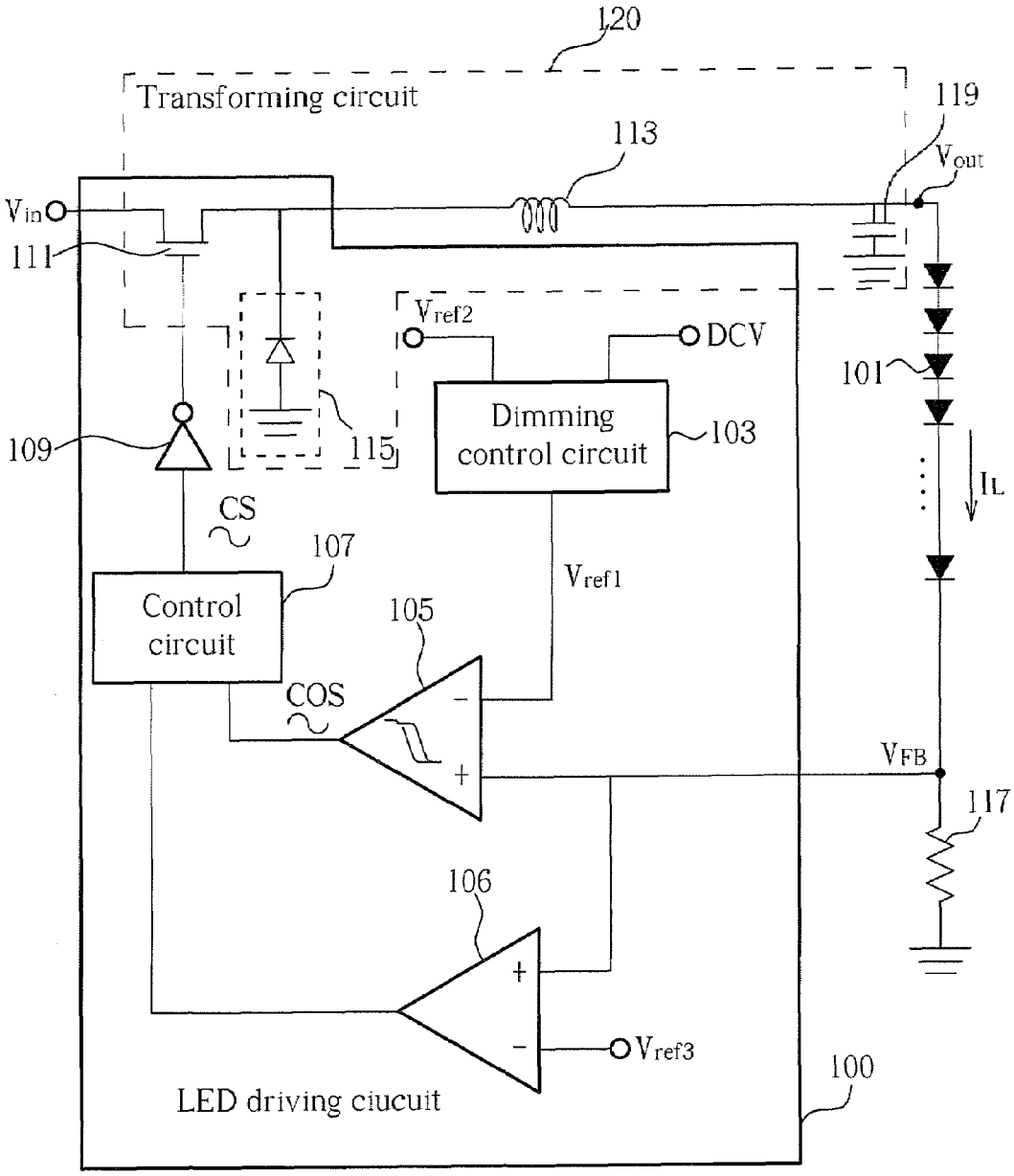
Fig. 1 Prior Art
FIG. 1 is a circuit diagram illustrating a prior art LED driving circuit
Figure 2:
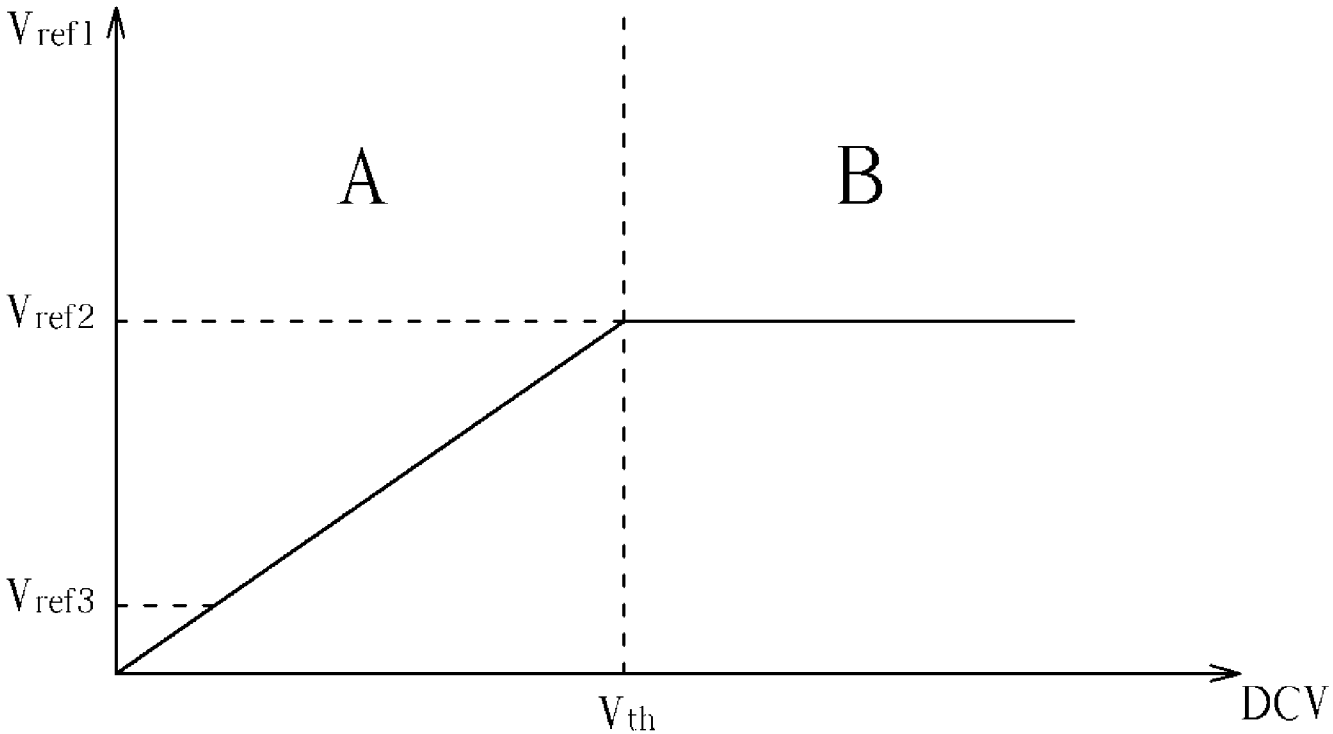
Fig. 2 Prior Art
FIG. 2 is a schematic diagram illustrating the relation of the first reference voltage, the second reference voltage, and the dimming control voltage shown in FIG. 1.
Figure 3:
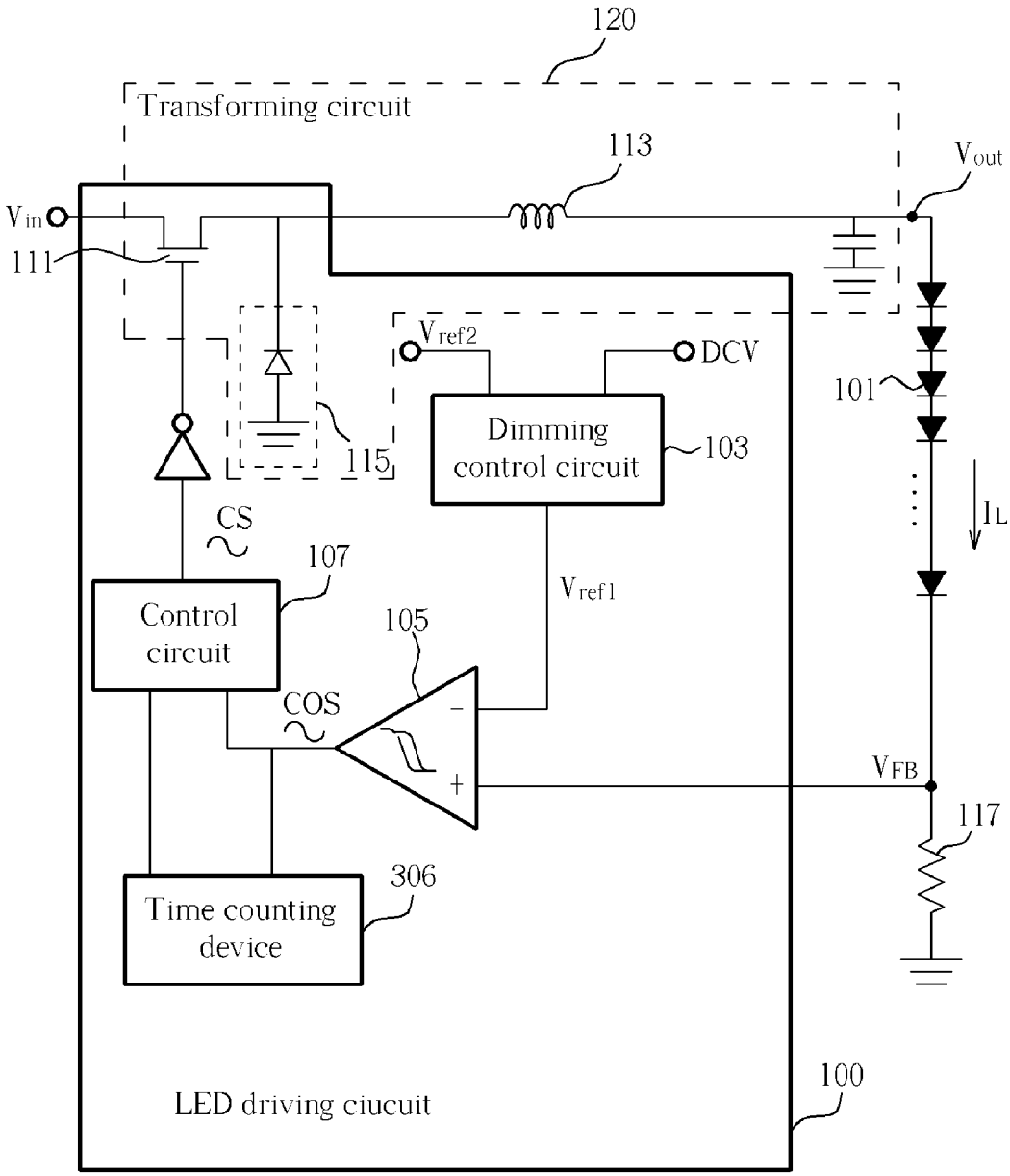
FIG. 3 is a circuit diagram illustrating a DC to DC converter according to an exemplary embodiment of the present invention.

FIG. 3 is a circuit diagram illustrating a DC to DC converter according to an exemplary embodiment of the present invention. As shown in FIG. 3, the comparator 106 shown in FIG. 1 is replaced with a time-counting device 306. The hysteresis comparator 105, the time-counting device 306, the control circuit 107 and the transforming circuit 120 constitute the DC to DC converter according to this embodiment of the present invention.

Figure 4:
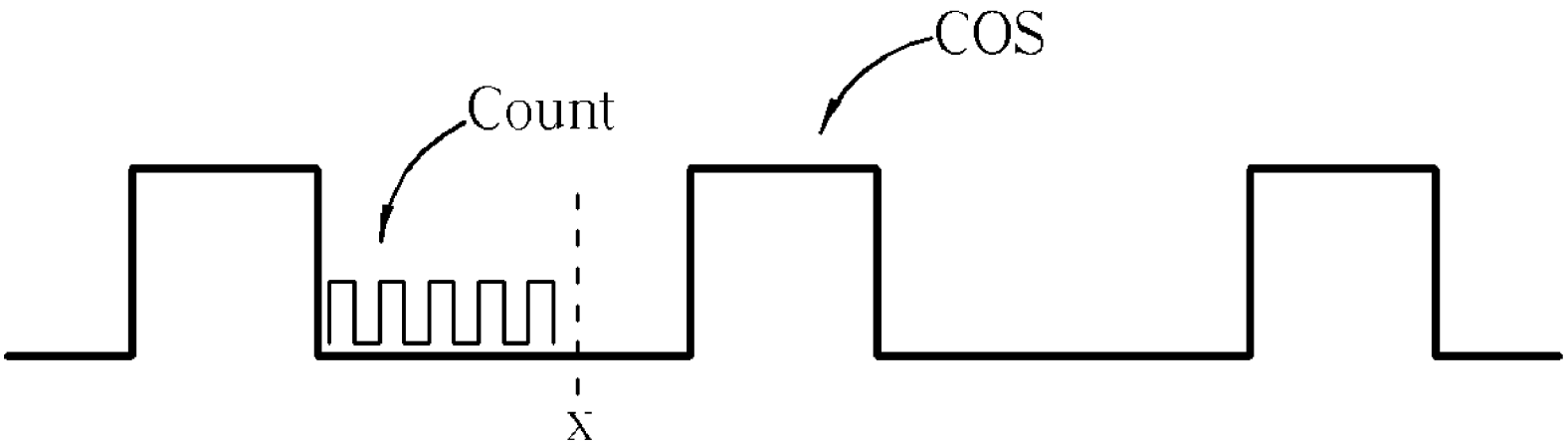
FIG. 4 is a schematic diagram illustrating the counting operation of the DC to DC converter shown in FIG. 3.

The feedback voltage $V_{FB}$ is 0 in the load open situation, and the comparing signal COS will maintain a specific voltage level correspondingly. In this embodiment, the time-counting device 306 is a counter and the comparing signal COS is at a low voltage level when the feedback voltage $V_{FB}$ is 0. Therefore the time-counting device 306 counts the low voltage level time of the comparing signal COS according to an inner clock thereof, as shown in FIG. 4. The time-counting device 306 informs the control circuit 107 that a load open situation occurs if the low voltage level of the comparing signal COS lasts a predetermined time, (for example, the mark X shown in FIG. 4), then the control circuit 107 turns off the NMOS 111 on the transforming circuit 120.

It should be noted that the time-counting device 306 is not limited to count the low voltage level of the comparing signal COS, the time-counting device 306 can also count the high voltage level of the comparing signal COS to determine if a load open situation happens. It also falls in the scope of the present invention. In other words, the DC to DC converter according to an exemplary embodiment of the present invention can detect the switch operation of the NMOS 111 (in other words the switch operation of the transforming circuit 120), and if the NMOS 111 is not switched for more than a predetermined time, a load open situation is presumed to happened. Such application also falls in the scope of the present invention.

In this embodiment, the transforming circuit 120 is the structure of a buck converter. The transforming circuit 120 includes an NMOS 111, an inductance 113, a diode 115 and a capacitance 119. Any DC to DC converter structure can be adopted as the transforming circuit 120 of the present invention. Besides, transforming circuit comprising other devices should also be fall in the scope of the present invention, and other devices with the same function can replace the NMOS 111 and diode 115. Additionally, the capacitance 119 can be omitted, if necessary.

As described above, the hysteresis comparator 105, the comparator 106, the control circuit 107 and the transforming circuit 120 constitute a DC to DC converter. It should be noted, however, that the DC to DC converter according to the embodiment of the present invention is not limited to be applied to light emitting devices such as an LED. The DC to DC converter can also be applied to other circuits or systems having loadings for detecting load open situations. Additionally, the hysteresis comparator 105 can be a normal comparator, if required.

According to the above-mentioned embodiment, since a contradiction between the load open determination and normal operation does not exist, an erroneous determination of an load open situation will not occur.

Those skilled in the art will readily observe that numerous modifications and alterations of the device and method may be made while retaining the teachings of the invention.

What is claimed is:

1. A DC to DC converter, comprising:

a transforming circuit, for transforming an input voltage to an output voltage;

a comparator, for comparing a reference voltage and a feedback voltage proportional to an output current to generate a comparing signal;

a control circuit, coupled to the transforming circuit and the comparator, for controlling the transforming circuit according to the comparing signal; and a time-counting device, coupled to the control circuit, for counting the time of a specific voltage level of the comparing signal;

wherein the time-counting device informs the control circuit that a load open situation occurs if the specific voltage level of the comparing signal lasts a predetermined time, then the control circuit turns off the transforming circuit.

2. The DC to DC converter of claim 1, wherein the time-counting device is a counter.

3. The DC to DC converter of claim 1, wherein the output voltage is provided to one end of at least one light emitting device, and the feed back voltage is from the other end of the light emitting device.

4. The DC to DC converter of claim 3, further comprising a dimming control circuit, for controlling the luminance of the light emitting device and for providing the reference voltage according to a desired luminance of the light emitting device.

5. The DC to DC converter of claim 1, wherein the transforming circuit comprises a NMOS, a diode, an inductance and a capacitor.

6. The DC to DC converter of claim 5, wherein the DC to DC converter further comprises an inverter between the control circuit and the transforming circuit.

7. The DC to DC converter of claim 1, wherein the transforming circuit comprises a NMOS, a diode and an inductance.

8. The DC to DC converter of claim 7, wherein the transforming circuit further comprises a capacitor.

9. The DC to DC converter of claim 1, wherein the comparator is a hysteresis comparator.

10. The DC to DC converter of claim 1, wherein the specific voltage level of the comparing signal indicates that the output current is about zero.

11. The DC to DC converter of claim 10, wherein the specific voltage level is 0 voltage.

12. A load open detection method for a DC to DC converter comprising a transforming circuit for transforming an input voltage to an output voltage, comprising:

(a) detecting a switching operation of the transforming circuit;

(b) determining a load open situation happened if the transforming circuit is not switched for more than a predetermined time;

(c) determining the load open situation happened if a feedback voltage substantially maintains at a voltage level for the predetermined time, wherein the feedback voltage represents an output current through a loading device driven by the transforming circuit;

(d) comparing a reference voltage and the feedback voltage to generate a comparing signal;

(e) checking if the specific voltage level of the comparing signal lasts more than the predetermined time; and (f) determining that the transforming circuit is not switched for more than the predetermined time if the specific voltage level of the comparing signal lasts more than the predetermined time.

13. The method of claim 12, wherein the transforming circuit comprises a NMOS, and the step (a) detects the switching operation of the NMOS.

14. The method of claim 12, wherein the voltage level is about 0 voltage.

15. The method of claim 12, further comprising:

turning off the transforming circuit if the load open situation is determined.

* * * * *